US006539597B1

(12) United States Patent
Calmerklint et al.

(10) Patent No.: US 6,539,597 B1
(45) Date of Patent: Apr. 1, 2003

(54) BRAKING DEVICE

(75) Inventors: Roland Calmerklint; Jonas Filipsson, both of Älmhult (SE)

(73) Assignee: Eltex of Sweden AB, Almhut (SE)

( * ) Notice: Subject to any disclaimer, the term of this patent is extended or adjusted under 35 U.S.C. 154(b) by 0 days.

(21) Appl. No.: 09/744,672

(22) PCT Filed: May 24, 2000

(86) PCT No.: PCT/SE00/01046

§ 371 (c)(1),
(2), (4) Date: Jan. 29, 2001

(87) PCT Pub. No.: WO00/73554

PCT Pub. Date: Dec. 7, 2000

(30) Foreign Application Priority Data

May 27, 1999 (SE) ..... 9901936

(51) Int. Cl.[7] ..... D02H 13/08

(52) U.S. Cl. ..... 28/187

(58) Field of Search ..... 28/172.1, 172.2, 28/185, 186, 187, 188, 189

(56) References Cited

U.S. PATENT DOCUMENTS

| | | | | | |
|---|---|---|---|---|---|
| 1,678,975 | A | * | 7/1928 | Cocker | 242/131.1 |
| 1,765,881 | A | * | 6/1930 | Reiners et al. | 242/131.1 |
| 2,002,137 | A | * | 5/1935 | Bruenn | 242/156.2 |
| 4,573,245 | A | * | 3/1986 | Pfister et al. | 28/187 |
| 4,610,059 | A | * | 9/1986 | Seaborn et al. | 28/187 |
| 4,646,989 | A | * | 3/1987 | Van Wilson | 242/131.1 |
| 4,664,335 | A | * | 5/1987 | Kohlen | 242/131.1 |
| 4,922,702 | A | * | 5/1990 | Meyer | 19/25 |

* cited by examiner

*Primary Examiner*—Danny Worrell
(74) *Attorney, Agent, or Firm*—Antonelli, Terry, Stout & Kraus, LLP

(57) ABSTRACT

The present invention relates to an apparatus for braking a thread (6) between a magazine (5) e.g. a thread bobbin, and a position of use (3) e.g. a warper, a signal emitter (18) being provided for generating an electric signal corresponding to the movement of the thread (6) and a thread brake (10) being disposed in the path of movement of the thread (6), the thread brake being provided with an electrically actuable driving unit (21), an energy-storing component (C19) with capacity for switching the thread brake (10) between a braking position and a disengaged position.

9 Claims, 10 Drawing Sheets

| | |
|---|---|
| FIG. 7A | FIG. 7C |
| FIG. 7B | FIG. 7D |

BRAKING DEVICE

The present invention relates to an apparatus according to the preamble to appended claim 1.

Prior art apparatuses according to the foregoing paragraph are applicable in warping machines for the textile industry and a warping machine or warper may be provided with a bobbin frame which can be 20–30 m in length, extend from floor to ceiling, and have a left-hand frame and a right-hand frame which are identical but are mirror-reversed. The frames are often placed in V-shape with the warp wrapping at the apex of the V. On each vertical post in the frame, there may be 8–10 thread bobbins in the vertical direction, and the distance between the posts may be 500 mm, which implies 16-20 threads per meter of bobbin frame, for which reason a 20 m long frame displays 20×16–20 threads (320–400 thread m each frame and, consequently, 640–800 threads in a frame). When stationary, the threads must be braked in order to avoid tearing off the threads from bobbins because of the weight of the threads. The most distal threads hang freely approx. 20 meters and it is not desirable to provide any braking support substantially because the braking would, in such an event, vary depending upon from how far away the threads come. At the start of the warper, the brake is in the engaged or braking position and when the warper has reached a certain speed, the brake is switched to the disengaged position. Thereafter, the warper increases speed to a thread speed as high as 250 kph. If anything happens, e.g. a break in a thread, the warper must be stopped very rapidly, and in order to prevent continued unreeling of the threads from the bobbins, the thread brakes must be switched to the engaged, braking position very rapidly. In prior art constructions, levers are provided all of the way from the end of each frame to each post where the movement of the levers is to be angled down on the post to each thread brake (8–10 in number). There are also designs and constructions employing a pneumatic piston for each post. The drawbacks inherent in these prior art constructions are obvious and serious. Above all, large mechanical masses are to be switched, and in the case of the pneumatic arrangement, long air hoses are also required which are to be filled. In addition to considerable mechanical complexity, the brakes operate extremely slowly, which is a major drawback.

The task forming the basis of the present invention is to obviate or at least reduce the drawbacks in prior art brake constructions in order to facilitate and improve the application of the brake apparatus according to the present invention, principally in warping machines.

This task is solved according to the present invention in the apparatus disclosed by way of introduction in that this is given the characterising features as set forth in appended Claim 1.

The present invention realises an apparatus for braking a thread in, for example, a warping machine possessing many advantages vis-à-vis constructions according to prior art technology. Such advantages are, for instance, more rapid engagement and disengagement, a fewer number of parts, simple adaptability to frames of different distribution, each post can be finished at the works, in the use of bistable magnets as driving unit only one pulse is required for switching between braking position and disengaged position, and in between no energy consumption is required, with electric energy storing capacitors for each brake driving unit it is sufficient to use a small mains unit for all the brake driving units, the charge in the capacitor may be sufficient for both engagement and disengagement of the brake, each unit is readily replaceable, no adjustment of mechanical parts, a single operating panel for controlling all brakes and units, easy to retrofit extant bobbin frames and possibly change the distribution between the posts, the apparatus can be given an extremely streamlined design without levers, air cylinders and hoses, etc.

One embodiment of the apparatus according to the present invention will now be described in greater detail hereinbelow, with reference to the accompanying Drawings.

Figure 1:
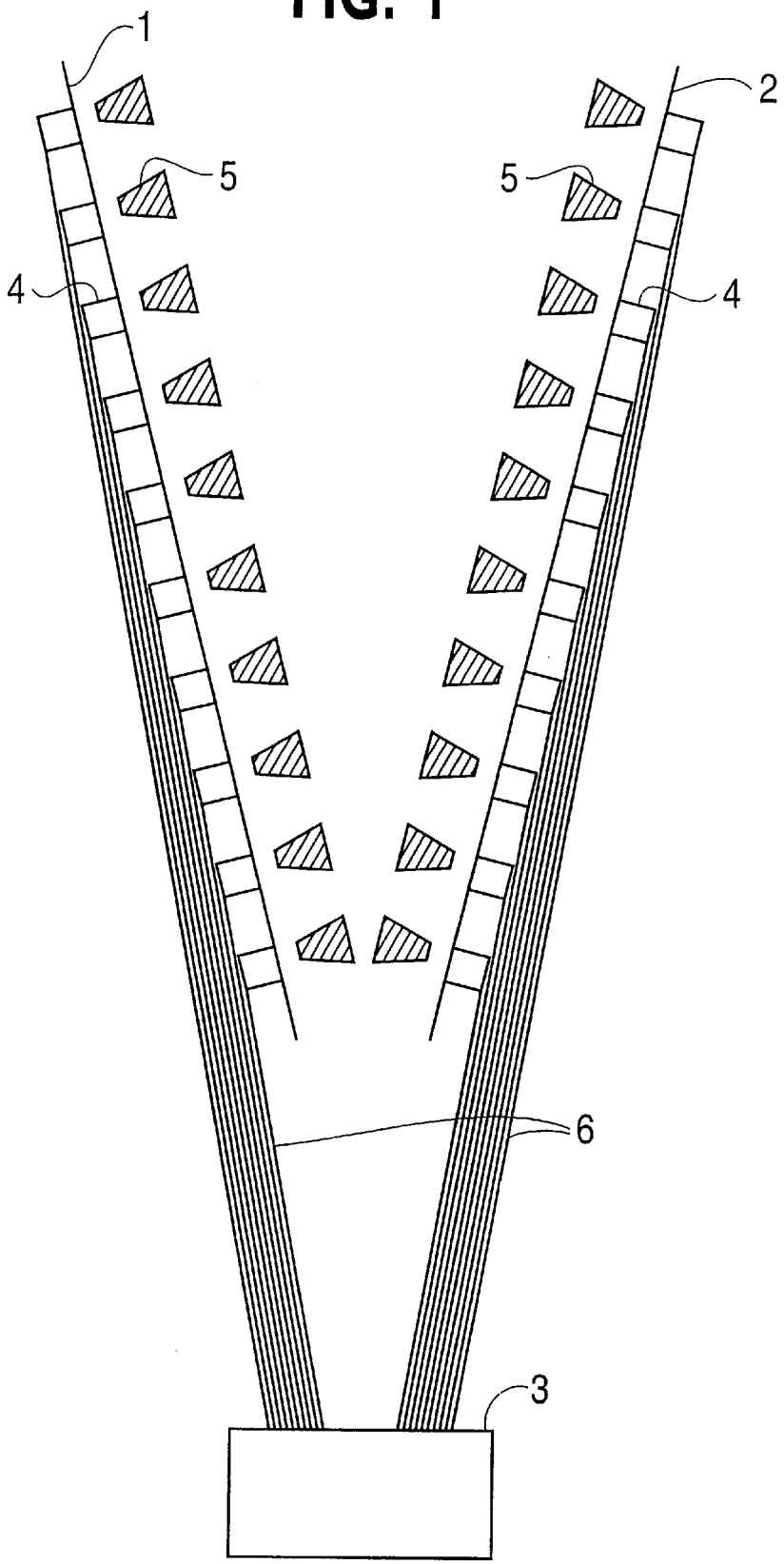
FIG. 1 is a schematic top plan view of a warping machine with brake apparatuses according to one embodiment of the present invention.

In FIG. 1, a warping machine is schematically illustrated, having a left-hand frame 1 and a right-hand frame 2, which are placed in V-shape and with a warper 3 at the apex of the V. Each frame 1, 2 has ten posts 4 which extend substantially at right angles to the plane of the Drawing and which support of number of thread bobbins 5 straight above one another. There may be as many as 8–10 thread bobbins 5 on each post 4. A large number of threads 6 will thus extend from the thread bobbins 5 via the posts 4 to the warper 3. If threads 6 from all bobbins 5 are to be included in the warp, the number of threads will amount to 640–800 in number. On the posts 4, there is a signal emitter for each thread and the signal emitter is disposed to generate an electric signal corresponding to the movement of the thread. The signal emitters are not shown in FIG. 1 and may be of any suitable type whatever, but in the present case a piezoelectric signal emitter is preferred which is coupled to an electric circuit of the type illustrated in FIG. 5.

Figure 2:
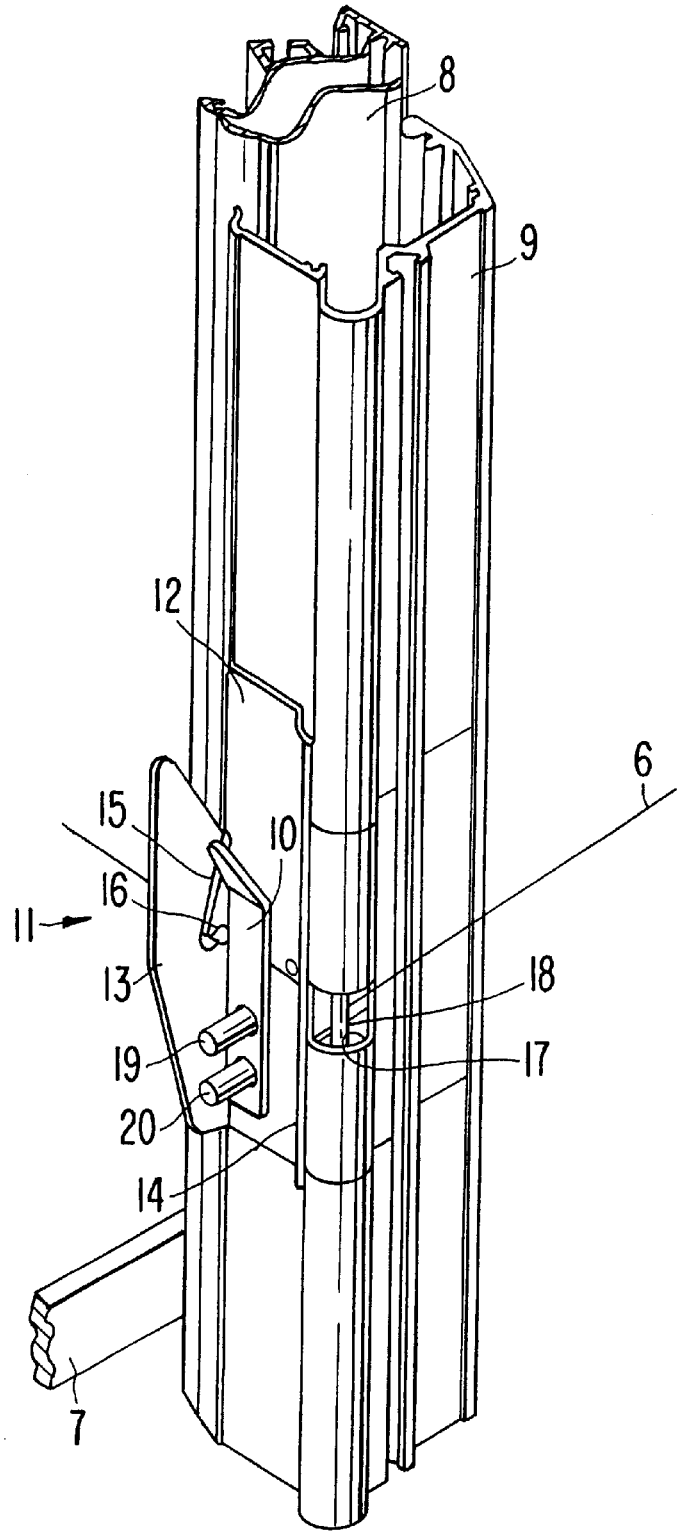
FIG. 2 shows a perspective view of a part of a post with a brake apparatus according to one embodiment of the present invention.
Figure 3:
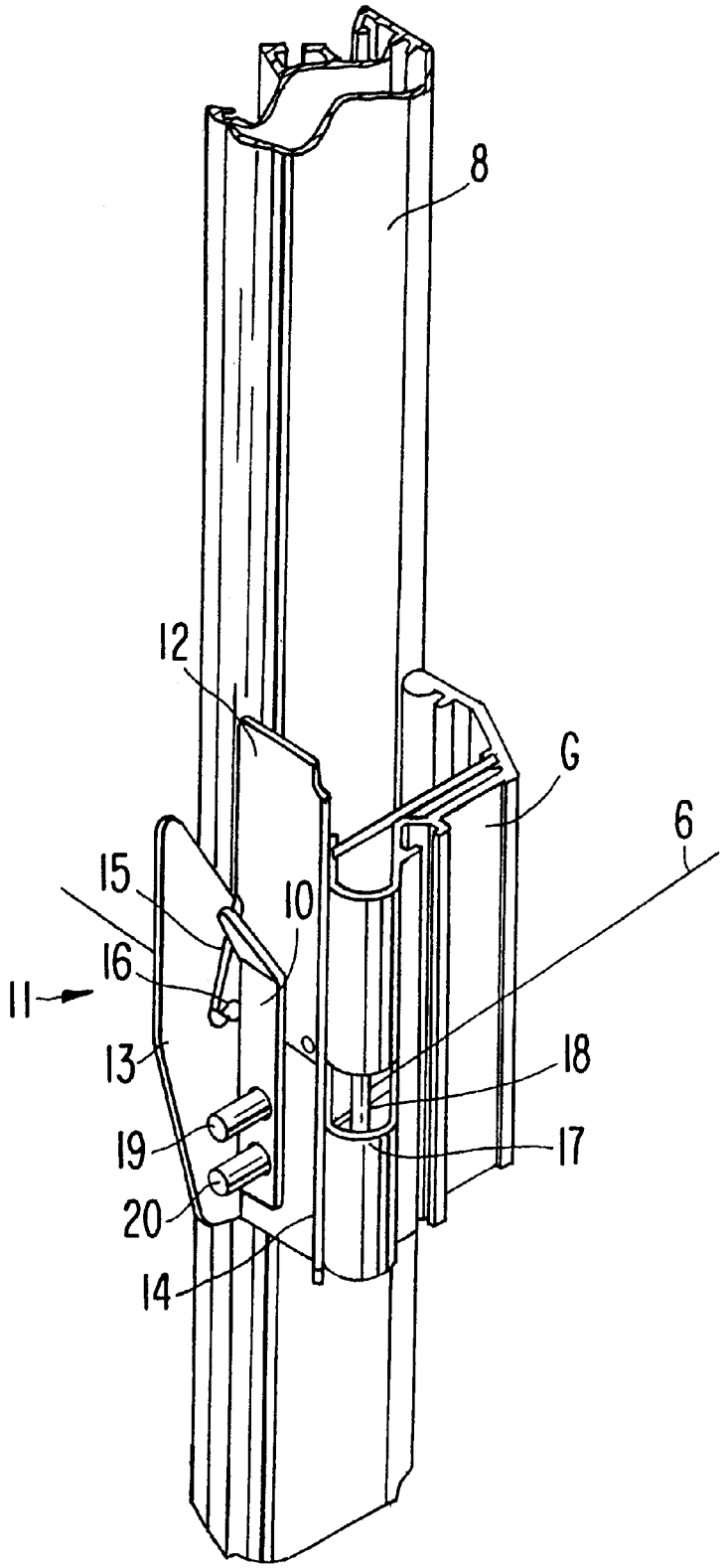
FIG. 3 shows a view similar to that of FIG. 2, certain parts having been removed.
Figure 4:
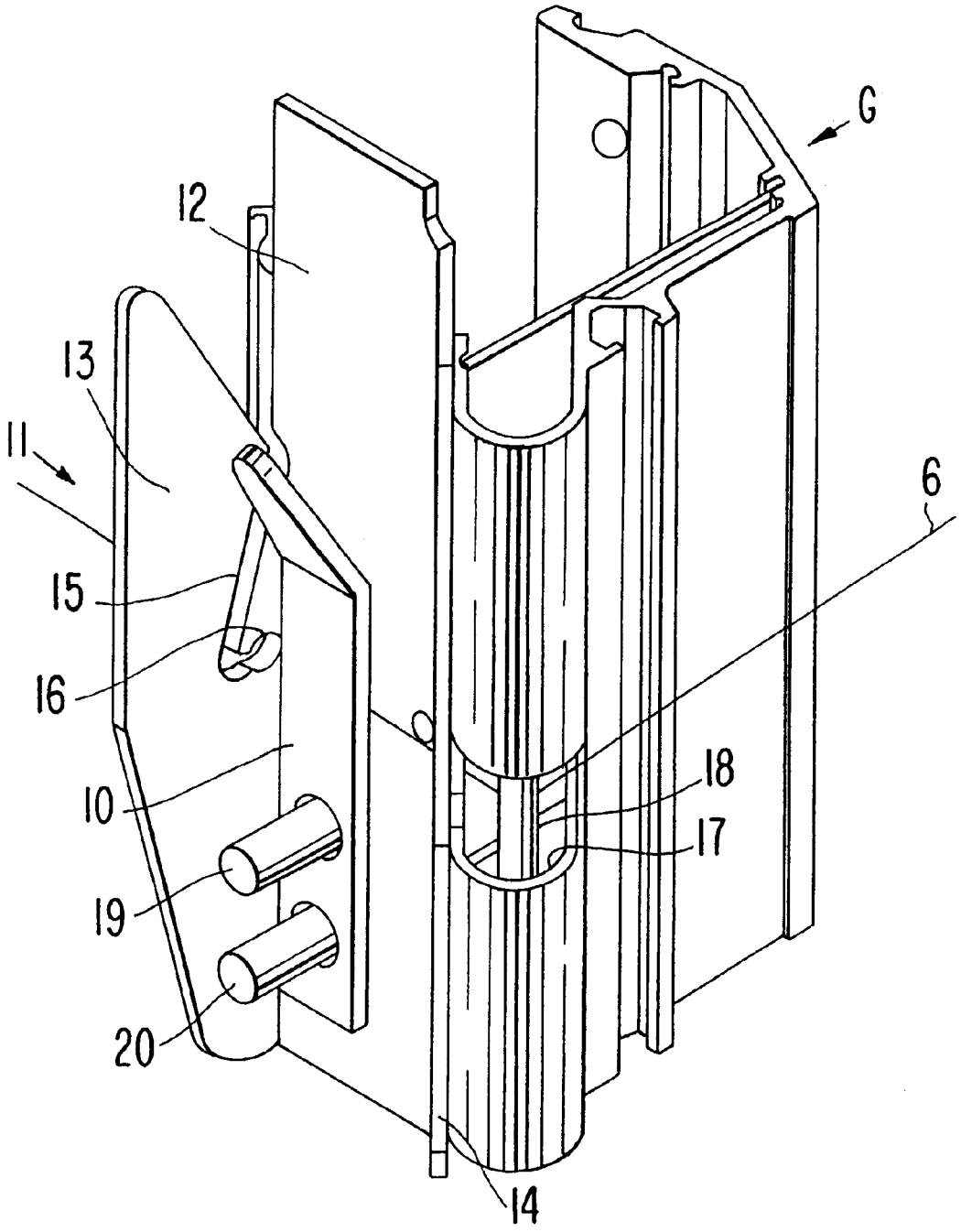
FIG. 4 shows, on a slightly larger scale, a similar view to FIGS. 2 and 3, further parts having been removed.
Figure 5:
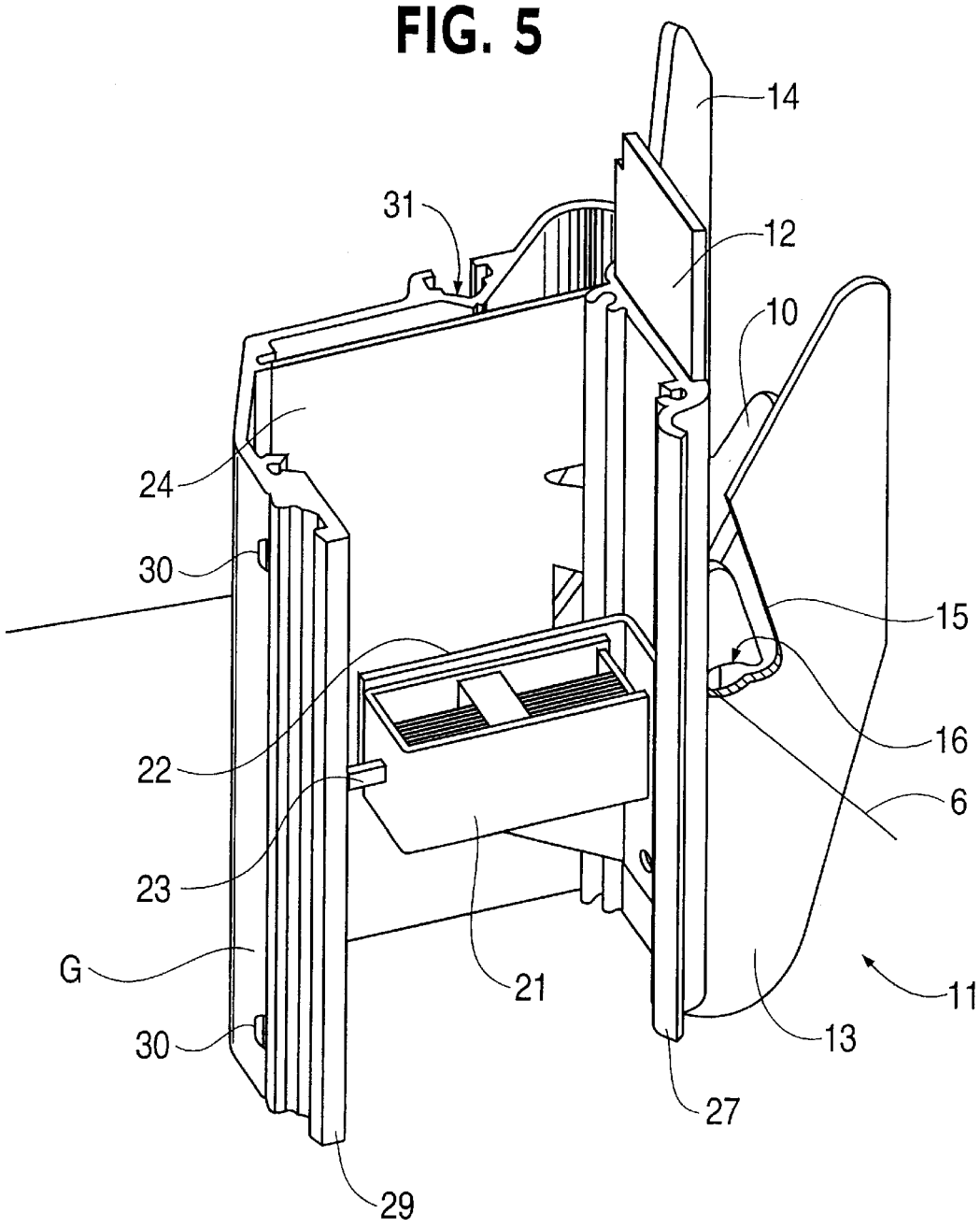
FIG. 5 is a perspective view of the part illustrated in FIG. 4 in another direction, substantially the opposite direction.

FIG. 2 shows a part of a post 4 which is mounted on a frame section 7 included in the frame 1, 2. The post 4 consists of a lower profile or carrier profile 8 and an upper profile or a lid 9. The profiles 8 and 9 are advantageously manufactured from aluminium and are drawn, whereby it will be simple to cut them and place an apparatus according to the present invention in the desired place as illustrated in FIG. 2. The carrier profile 8 advantageously extends from floor to ceiling, while the upper profile 9 may, as illustrated in FIGS. 3, 4 and 5, be cut in 100 mm long emitter lengths G for the components included in an apparatus according to the present invention such as circuit card, signal emitter, brake and driving unit. Between the emitter lengths G, there are disposed covering upper profiles 9 and the emitter lengths may be disposed with different distribution with upper profile parts 9 of different lengths between them. Uppermost on each post 4, there is a module with an indicator and possibly electronics for power supply and voltage stabilisation.

The embodiment of the present invention illustrated in the Drawings includes a brake shoe 10 which, in the Figures, is shown in the engaged or braking position, in which the brake shoe 10 clamps a thread 6 against a part of a thread guide 11. The thread guide 11 has a bottom portion 12 and a portion 13 extending at right angles in relation to the bottom portion 12, and a portion 14 extending at a greater angle in relation to the bottom portion 12. The portions 13 and 14 each have a groove for leading the thread 6 to a guide eye 16. Substantially centrally of the eye 16 in the thread guide portion 14, an aperture 17 is provided in the corner of the upper profile 9 or a separate part of the profile 9, in which aperture a signal emitter element 18 is placed for being influenced by the thread 6. The signal emitter element 18 may be of any suitable construction whatever, but, in the present case, a piezoelectric signal emitter element is preferred, but could just as well consist of any other type of signal emitter element depending upon the properties which are required of the signal emitter element 18 for obtaining the desired signal on movement of the thread 6.

The brake shoe 10 is mounted on the bottom portion 12 of the thread guide 11 on two pins 19 and 20. In order to be switchable from the engaged or braking position illustrated in FIG. 2 with the thread 6 clamped against the bottom portion 12 of the guide 11 to the disengaged position angled outwards from the bottom portion 12 in which the threads 6 may be displaced past the brake shoe 10 unimpeded, a spring is disposed to urge the brake shoe 10 in a direction towards the engaged or braking position illustrated in FIG. 2. At least the pin 19 is threaded for a nut which, via a washer, urges the spring against the brake shoe 10 and this towards the braking position. The other pin 20 is disposed to retain the brake shoe 10 in the desired position, in which switching of the brake shoe to the different positions is permitted.

Figures 6, 7:
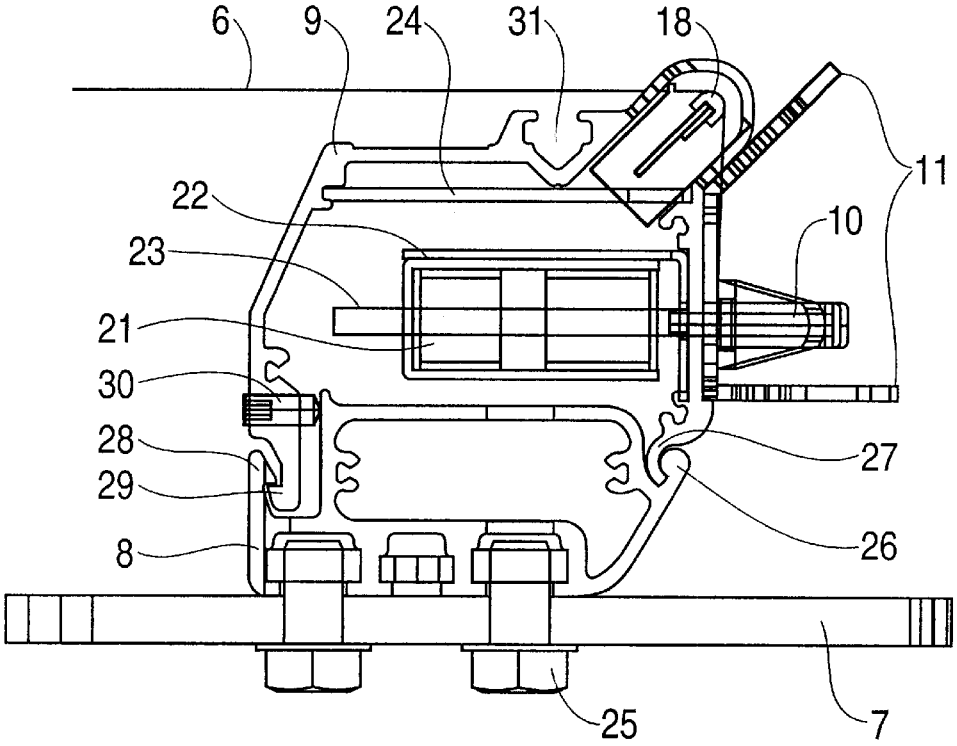
FIG. 6 is a top plan view of a post according to one embodiment of the present invention illustrated in FIGS. 2, 3 and 4.
FIG. 7 shows a coupling diagram of an electronic circuit for an apparatus according to the present invention.
Figure 7A:
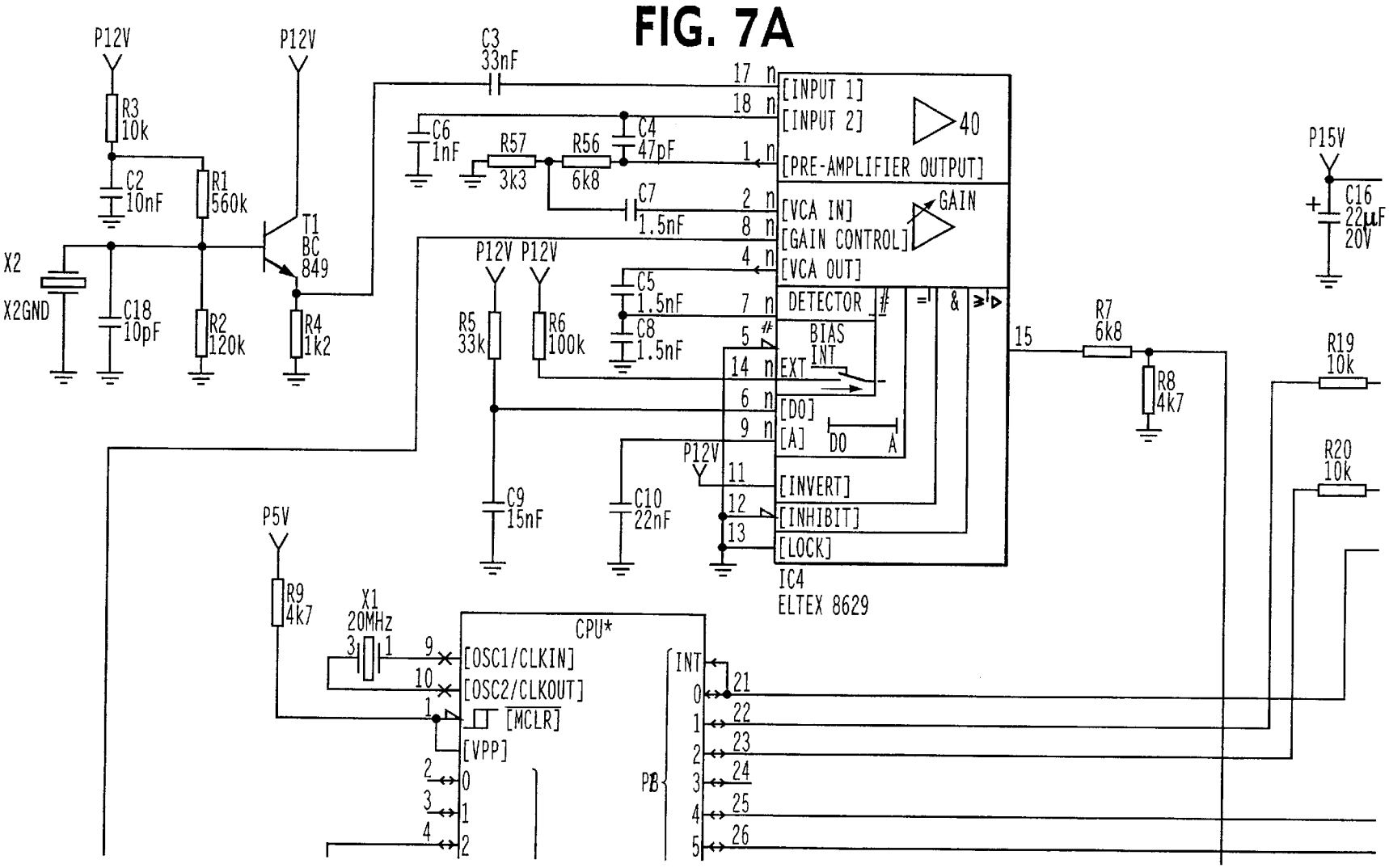
Figure 7B:
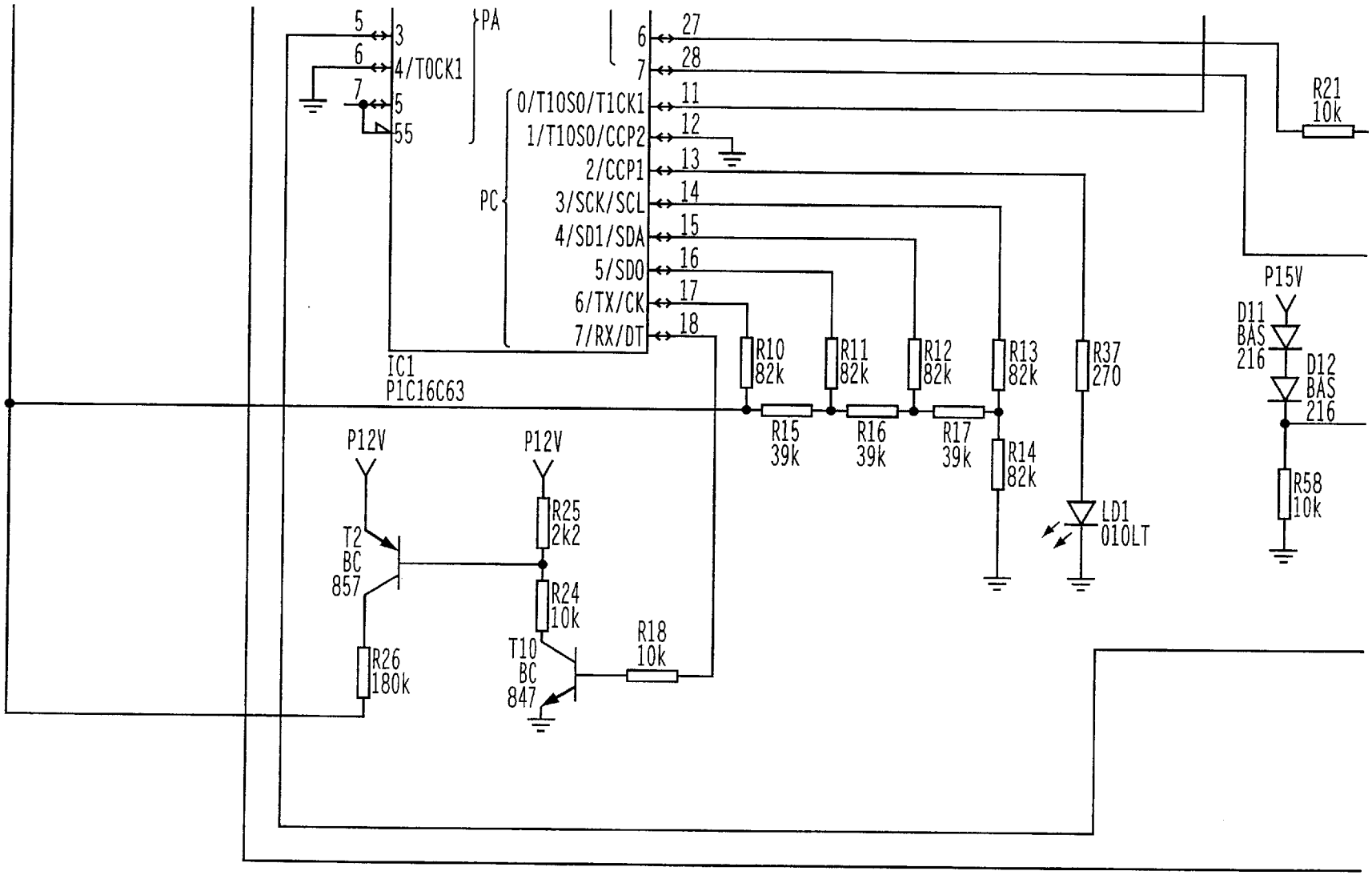
Figure 7C:
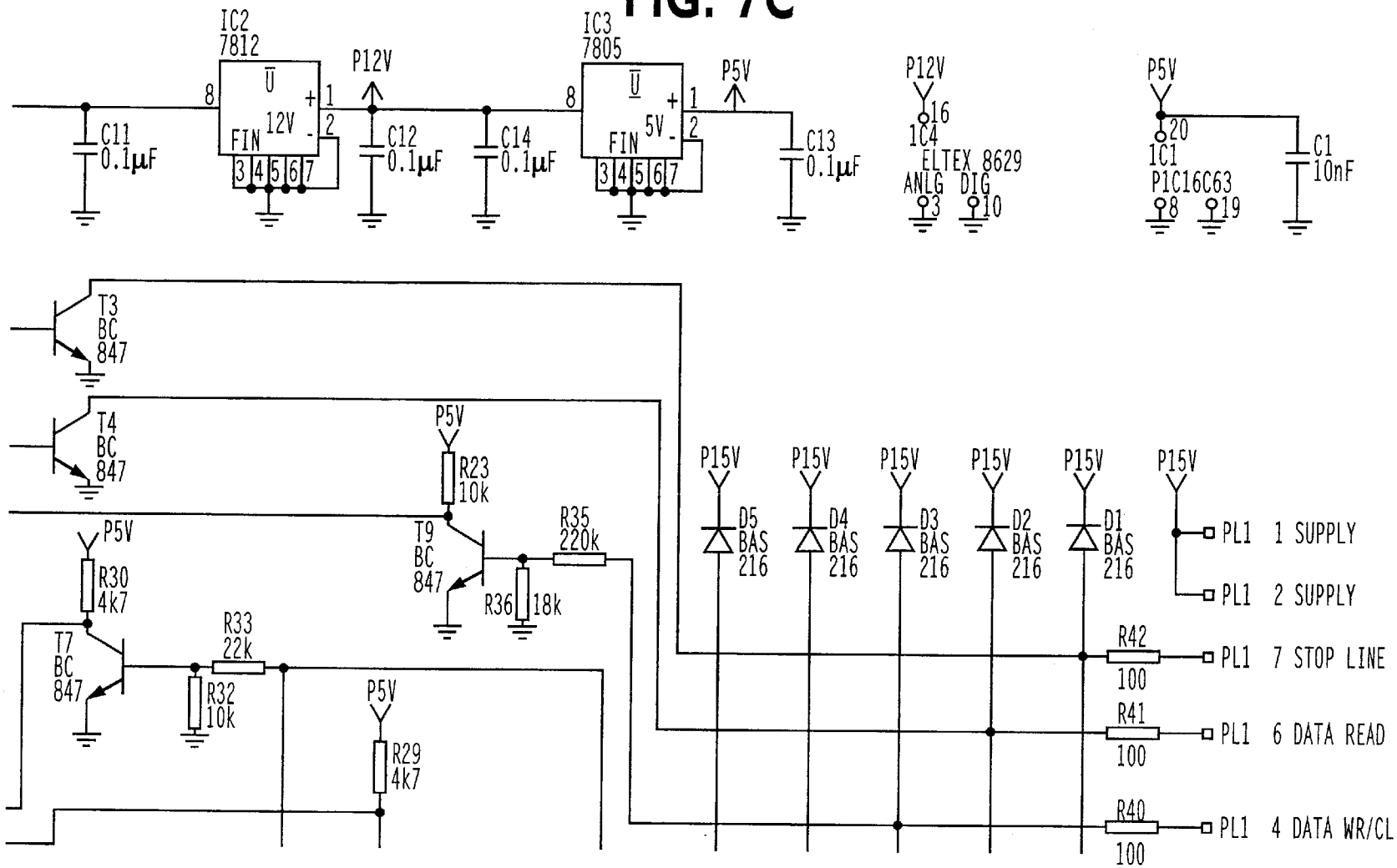
Figure 7D:
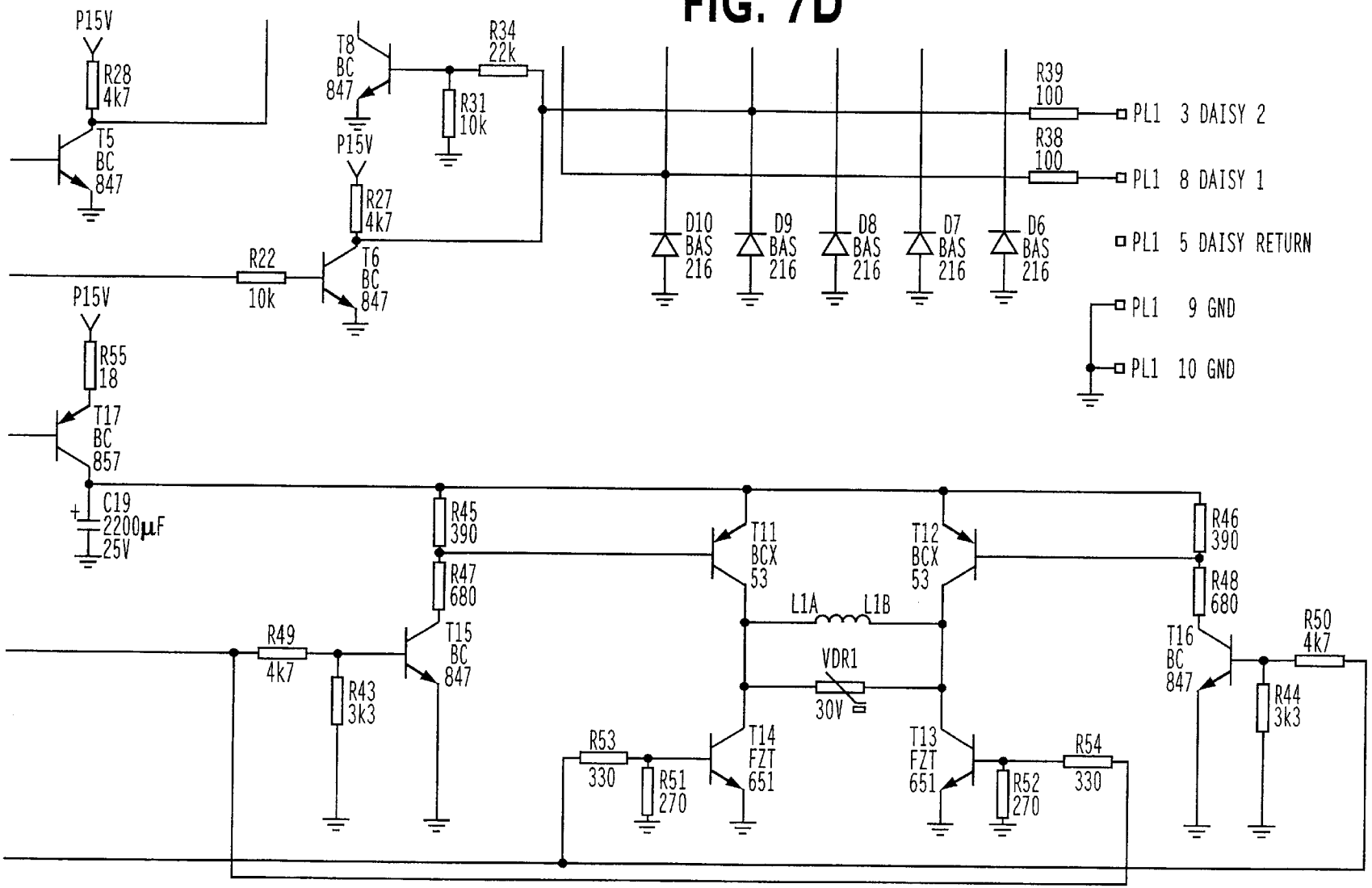

In the present embodiment, a driving unit is provided for switching the brake shoe 10 between the two positions, and this driving unit consists, in this embodiment, of a bistable magnet 21 which is shown in greater detail in FIGS. 5 and 6. The magnet 21 is mounted on a retainer plate 22 which is an angled plate with an aperture for the anchor 23 of the magnet 21, so that the anchor 23 is capable of coming into contact with the brake shoe 10 and switching it to the disengaged position, in which the magnet anchor 23 is located in the position opposite to the position in FIGS. 5 and 6 or furthest to the right in FIGS. 5 and 6. In this position, the brake shoe 10 is angled out from the bottom portion 12 of the thread guide 11. The retainer plate 22 is advantageously secured in the upper profile, as shown in FIG. 6. In the upper profile 9, there is further provided a circuit card 24 which may support the electric circuit illustrated in FIG. 7, which will be described in greater detail below. FIGS. 5 and 6 illustrate more closely how the lower profile 8 or carrier profile is secured on the frame section 7 by means of number of bolts 25. In FIGS. 5 and 6, it is further apparent that the lower profile 8 has a pivot point for a lip 27 on the upper profile 9. Further, the lower profile 8 has a locking catch 28 for co-operation with a locking catch 29 on the upper profile 9. For fixing the upper profile 9 on the lower profile 8, there is further provided a locking screw 30.

In that the profiles 8 and 9 are manufactured by drawing of aluminium, it is easy to provide the profiles 8 and 9 with relatively complicated configuration and with various auxiliary grooves, e.g. a groove anchorage 31 for an extra guide if this appears to be desirable.

The electronic circuit illustrated in FIG. 7 for the circuit card 24 displays, in the left-hand upper corner, a circuit section for processing the signal from the signal emitter 18 which is designated XZ. In the upper, right-hand corner, there is shown a circuit section which serves for voltage stabilisation. In the left-hand lower corner are shown circuit components for adjusting the amplification in that part which processes the signal from the emitter XZ. In the CPU, the actual thread monitoring function takes place, while a level adjustment communication takes place in the centrally disposed circuit section which includes the transistors T3–T8 and immediately associated circuit components. The terminal box placed centrally to the right serves for connecting the circuit to a central unit and the components between the terminal box and the level adaptation communication section serve for so-called EMC protection. In the lower, right-hand corner are shown the electronic components in the driving unit for the bistable magnet 21 and the coil in the magnet 21 is designated L1 and this is supplied with a switching pulse by means of a capacitor C19 in which the electric energy is stored which is required for switching the brake magnet 21 to the disengaged position and thence to the engaged, braking position. The current to the capacitor C19 is obtained from a constant current generator in which the transistor T17 is included and the immediately connected components.

For a person skilled in the art, with the aid of the circuit diagram illustrated in FIG. 7 and the preceding and following description, it is easy to reduce the present invention into practice.

From a central unit (not shown), a bus cable extends with ten conductors to the first post 4 in the warp position, and is connected to the terminal box illustrated to the right in FIG. 7. Four conductors in the cable serve for current supply, one conductor for emergency stop, two conductors to so-called relay lines, one to feed-back, one to a clock pulse conductor and one to a computer conductor. As was mentioned, the cable runs to the first post at the warp and is connected in this to a branch unit with an indicator lamp for indicating stop from any emitter on the post 4, voltage stabilisation for the emitters of the post 4, fusing, buffer storage of signals from the emitters of the post and switching and buffer storage for bussing to the next post. The relay line entails that all emitters will be electrically connected in series. The cable is a flat cable with clamp contacts. The relay line is to be broken or "cut off" at each emitter and, as a result, two conductors are employed for the relay line. Between each contact, one of the relay lines is cut off. Between every second contact, the conductor 1 has been cut and between the next conductor 2. The emitters are designed such that the relay signal can enter any way whatever, "from ahead" or "from behind". The signal which physically always comes from the same direction enters every second emitter in on the relay conductor 1 and on the next in the relay conductor 2.

The relay system functions such that if the output is set at low in terms of voltage from the central unit it will be low in all units. When the signal is then set at high from the signal unit, the signal reaches the first emitter. In this, one of the relay poles of the emitter will then be high and other low. When a clock pulse is emitted from the central unit and reaches all of the emitters at the same time, one emitter which has the above-mentioned status will transmit back a stream of data with various items of information. Once completed it lays out a high signal level also on the relay pole which is low. Hereby, the next emitter on the line will have the same status as the first and the process is repeated for this emitter. At the same time, the central unit can count how many clock pulses it has emitted and thereby, on the one hand, know which emitter it is "speaking" to and, on the other hand, know how many which have been completed. The last emitter in the chain is thereafter connected to the feedback. In this manner, the central unit will have knowledge of when it has gone through all emitters. By such means, it is possible to transmit a relatively large number of data information items to the emitters. Certain of the information items are understood only by the emitters which have both relays lines in high status, certain of them which have both lines low and certain items of information can be read by all emitters. The emitter which is selected by having a high and low relay level can both "speak" and "listens".

In the apparatus according to the present invention, the emitters are provided with an output for driving the magnet 21 for switching the brake shoe. As was mentioned above, it is possible to transmit items of information to all emitters, while the emitters "speak" only one at a time. Information items can be transmitted either to the emitters "before" the relay signal or to the emitters "after" the relay signal.

When the warping machine is stationary, the brakes 10 are in the engaged, braking position. The warping machine starts slowly in order gradually to increase speed and, on achieving a certain speed, a message is transmitted to all emitters that the brake shoe 10 is to be switched to the disengaged position. This takes place with the aid of the bus cable, which may be extant equipment in those cases extant emitter installations are to be supplemented with braking apparatuses according to the present invention, or with new emitters which are provided with a braking apparatus according to the present invention. The bus cable is further employed to set a number of parameters in the emitters (the circuit card according to FIG. 6) from an operating or central unit, e.g. sensitivity, rapidity, sensitivity to bouncing threads, fault indication, etc. The central unit is, as it were, self-learning and informs an operator as to how many threads are in operation. Thus, there will not be required any switching of the emitters if they are not to monitor threads or to be without threads. The controlling of the brakes can thus be carried out without any further wiring or installation. All emitters emit then a pulse of between 10–30 ms to their brake magnet 21 and this switches position. The current to each magnet is of the order of magnitude of 100 mA. If this energy were to be fed out direct from a central mains unit, the current would be 100 A if there are 1,000 emitters and extremely heavy-duty cables would be required and a powerful mains supply unit. In each emitter in the apparatus according to the present invention are included the storing capacitor C19 whose capacity is, in one preferred embodiment, selected so as to handle at least two operations directly after one another "off" and "on" to the brake shoe 10. This is of certain importance, since many faults occur precisely in the start-up phase and, in such an event, a rapid stop is required. With the aid of the constant current generator in the apparatus according to the present invention, the power supply of the capacitor can be spread over a longer period of time. If the pulse from the capacitor C19 is to be ms and the capacitor C19 be charged in three seconds, the relationship will be that only 1/100 of the actual current must be supplied from the mains unit.

In the present invention, use is made of a bistable electromagnet 21 for controlling the brake shoe 10. Such a bistable electromagnet has good mechanical strength in both positions. A similar function can be achieved using other components than a bistable electromagnet. It is possible to employ an electric motor, but it is also conceivable to employ other components for switching the brake shoe 10. The braking force is determined by a spring which can be placed on the stub shaft 20. It may be further be possible to regulate the braking force by causing the magnet to execute several strokes and thereby progressively increase the braking force. In such an event, it may be desirable to employ another type of driving unit than a bistable electromagnet.

Many modifications are naturally conceivable in the embodiment according to the present invention described in the foregoing without departing from the inventive concept as defined in the appended claims.

What is claimed is:

1. An apparatus for braking a thread on a path between a magazine and a position of use in a textile machine, said apparatus comprising:

a signal emitter for generating an electrical signal corresponding to the movement of the thread on the path.

a thread brake on the path, said thread brake being switchable between a braking position, in which movement of the thread on the path is prevented, and a disengaged position, in which movement of the thread on the path is permitted;

an electrically actuable driving unit, responsive to the electrical signal from the signal emitter, for switching the thread brake between the braking position and the disengaged position, said driving unit including an energy storing component for storing energy for switching the thread brake between the braking position and the disengaged position.

2. The apparatus as claimed in claim 1 wherein the driving unit is adapted to switch the thread brake between the braking position and the disengaged position in one or more steps or continuously.

3. The apparatus as claimed in claim 1, wherein the driving unit further includes a bistable electromagnet.

4. The apparatus as claimed in claim 1, wherein the energy-storing component is arranged to store a sufficient quantity of energy for switching the thread brake from the braking to the disengaged position and back to the braking position.

5. The apparatus as claimed in claim 4, wherein the energy-storing component is a capacitor for storing electrical energy.

6. The apparatus as claimed in claim 3, wherein the energy storing component is arranged to store a sufficient quantity of energy for switching the bistable electromagnet twice.

7. The apparatus as claimed in claim 2, wherein the driving unit further includes a bistable electromagnet.

8. The apparatus as claimed in claim 5, wherein the capacitor is arranged to store a sufficient quantity of electrical energy for switching the bistable electromagnet twice.

9. The apparatus as claimed in claim 7, wherein the energy storing component is arranged to store a sufficient quantity of energy for switching the bistable electromagnet twice.

* * * * *